US009386804B2

(12) United States Patent
Gollobin

(10) Patent No.: US 9,386,804 B2
(45) Date of Patent: Jul. 12, 2016

(54) CIGARETTE HOLDER

(76) Inventor: Peter Gollobin, Mineola, NY (US)

( * ) Notice: Subject to any disclaimer, the term of this patent is extended or adjusted under 35 U.S.C. 154(b) by 973 days.

(21) Appl. No.: 13/596,522

(22) Filed: Aug. 28, 2012

(65) Prior Publication Data

US 2013/0047998 A1 Feb. 28, 2013

Related U.S. Application Data

(60) Provisional application No. 61/528,354, filed on Aug. 29, 2011.

(51) Int. Cl.

| | |
|---|---|
| ***A24F 13/08*** | (2006.01) |
| *A24F 13/22* | (2006.01) |
| *A24F 13/02* | (2006.01) |
| *A24F 13/10* | (2006.01) |

(52) U.S. Cl.

CPC ..... *A24F 13/08* (2013.01); *A24F 13/02* (2013.01); *A24F 13/10* (2013.01); *A24F 13/22* (2013.01)

(58) Field of Classification Search

CPC ..... A24F 13/02; A24F 13/08; A24F 13/22; A24F 13/00; A24F 13/10

USPC ..... 131/182, 328, 178, 189, 190, 191, 250, 131/257, 260

See application file for complete search history.

(56) References Cited

U.S. PATENT DOCUMENTS

| | | | | | |
|---|---|---|---|---|---|
| 188,992 | A * | 3/1877 | Tiedemann | A24F 9/14 | 131/186 |
| 895,568 | A * | 8/1908 | Leu | A24F 13/08 | 131/186 |
| 1,447,664 | A * | 3/1923 | Hollingsworth | A24F 13/08 | 131/182 |
| 1,487,407 | A * | 3/1924 | Thomas | A24F 13/08 | 131/188 |
| 1,508,514 | A * | 9/1924 | Furton | A24F 13/08 | 131/190 |
| 1,551,973 | A * | 9/1925 | Brooks | A24F 13/08 | 131/182 |
| 1,613,545 | A * | 1/1927 | Teigen | A24F 13/08 | 131/182 |
| 1,672,194 | A * | 6/1928 | Becker | A24F 13/08 | 131/190 |
| 1,730,033 | A * | 10/1929 | Faranda | A24F 13/14 | 131/175 |
| 1,767,927 | A * | 6/1930 | Husted | A24F 13/08 | 131/190 |
| 2,228,951 | A * | 1/1941 | Franklin | A24F 13/10 | 131/182 |
| 2,546,127 | A * | 3/1951 | Lewis | A24F 13/08 | 131/190 |
| 4,250,900 | A * | 2/1981 | Campbell | A24F 13/02 | 131/187 |
| 4,832,057 | A * | 5/1989 | Bale | A24F 17/00 | 131/329 |
| 5,645,089 | A * | 7/1997 | Burger | A24F 5/40 | 131/105 |
| 6,050,268 | A * | 4/2000 | San Filippo | A24F 13/22 | 131/187 |
| 2010/0139673 | A1 * | 6/2010 | Miller | A24F 13/22 | 131/187 |

* cited by examiner

*Primary Examiner* — Linda L Gray

(74) *Attorney, Agent, or Firm* — Galgano IP Law PLLC; Thomas M. Galgano; Jessica G. McDonald

(57) ABSTRACT

A cigarette holder, including a hollow tube having a front end serving as a mouthpiece and a rear end over which the non-burning end of a cigarette is receivable and a clip attached to the tube. The clip includes a pair of cooperating, opposing, openable jaws to removably hold the non-burning end of the cigarette over the rear end of the tube, to form an airtight seal. The jaws each have an opposing end tip and are movable from a closed position where the end tips are in contact with each other to an open position where the end tips are spaced apart from each other. The jaws can also be used to open the non-burning end of the cigarette so that it fits over the rear end of the tube.

21 Claims, 4 Drawing Sheets

CIGARETTE HOLDER

CROSS-REFERENCE TO RELATED APPLICATION

This application claims benefit from U.S. Provisional Patent Application No. 61/528,354, filed Aug. 29, 2011, the contents of which are hereby incorporated by reference.

BACKGROUND OF THE INVENTION

1. Field of the Invention

The present invention relates to a holder for a cigarette, a device for cleaning the cigarette holder and methods of use thereof. Particularly, the present invention is directed to a hollow tube with an attached clip for attaching a cigarette to enable smoking of the cigarette until it is completely burned up, while also lengthening the distance between the burning embers and the smoker. The jaws of the clip are also used to prepare the non-burning end of the cigarette so that it will form an airtight attachment to the cigarette holder.

2. Brief Description of the Prior Art

The cost of tobacco and tobacco-type products have increased over the years making it desirable not to waste even a small amount of the substance smoked, as the burning embers near the smoker. It is also desirable to distance the smoker from the hot burning embers, especially as the embers near the smoker.

It has been well known for many years that there are many different configurations of cigarette holders. Certain of the prior art cigarette holders have a hollow tube with a front end and a rear end. The inner diameter of the front end is slightly smaller than the outer diameter of the cigarette, so that the cigarette can be forcibly inserted therein and will be held within the cigarette holder by a friction fit. In these prior art cigarette holders, it is important that the cigarette fits snuggly inside the front end of the cigarette holder so that no air can enter the cigarette holder at the junction with the cigarette. When the smoker sucks air from the rear end of the cigarette holder, the air is drawn in through the burning embers only and, thereby, creates the smoke to be inhaled by the smoker.

While in the past all cigarettes were the same standard diameter, there are now many different types of cigarettes, some called "slims," with different diameters. In addition, hand rolled cigarettes vary from cigarette-to-cigarette and from person-to-person. One of the problems that a smoker experiences with the prior art cigarette holders is that cigarettes can have many different outer diameters and, therefore, a smoker would require many different cigarette holders with various sized inner diameters to make the necessary snug, airtight fit around the cigarette to prevent air from entering the junction between the holder and the cigarette.

Another problem experienced by smokers using certain of the prior art cigarette holders is that, after a number of uses, a tar type residue builds up on the inside of the hollow tube from the by-products of the smoke traveling through it, necessitating that the hollow tube must be periodically cleaned. A pipe cleaner device that is constructed from twisted wire and short bristles is inserted into the hollow tube to clean it. The pipe cleaner must be pushed and pulled many times through the hollow tube to remove much of the tar type substance. However, there is no guarantee how much of the residue is removed and over time some hardens and cannot be removed by the bristles of the pipe cleaner. Therefore, after time, the cigarette holder must be either chemically cleaned or discarded because the thickness of the dried tar increases to the point where it restricts the flow of the smoke to an unacceptable level.

Other common methods of holding a cigarette so that it can be smoked to completion involve a clip either similar to an "Alligator-type" electrical clip, or a clip made using any number of different configurations of bent wire. These clips are used to hold the non-burning end of the cigarette so that the burning embers do not burn the smoker's fingers as they smoke the cigarette to completion. The cigarette is held by the clip close to the non-burning end at a right angle to the axis of the clip to allow the non-burning end to touch the lips of the smoker to enable the smoker to draw in the smoke. Embodiments of this type of clip range from the common electrical "Alligator-type" clips to bent wire formed into a variety of generally U-shape configurations where the ends of the "U" are the jaws and the spring of the bent wire is used to clamp onto the end of the cigarette. In common with all these embodiments is the requirement that the cigarette be held at a right angle to the jaws of the clip to allow room for the smoker's lips to touch the non-burning end, so as to draw in the smoke.

The disadvantages of these type of devices is that, as the cigarette burns towards completion, the hot burning embers come very close to the lips of the smoker and can easily burn the smoker's lips. Also, the temperature of the smoke rises to an uncomfortable level as the burning embers get nearer to the smoker as the cigarette burns to completion.

While the prior art discloses many types of cigarette holders, so far as is known, none of these holders resolve these problems in a simple, effective and highly advantageous manner, as in the present invention.

SUMMARY OF THE INVENTION

Accordingly, it is an object of the present invention to provide a novel and improved cigarette holder that will hold various size diameters of cigarettes.

It is also an object of the present invention to form an airtight seal between the cigarette holder and the rear, non-burning end of the cigarette.

It is a further object of the present invention to provide a cigarette holder which will allow the cigarette to be smoked to completion, utilizing all of the tobacco within it.

It is yet another object of the present invention to provide a cigarette holder which will protect the lips of the smoker from being burned as the burning embers of the cigarette burn to completion.

It is still another object of the present invention to provide a cigarette holder that cools the temperature of the smoke created by the cigarette before entering the mouth and lungs of the smoker.

It is also an object of the present invention to provide a cigarette holder that provides a means to open the rear end of the cigarette to allow it to fit over the hollow tube.

It is still a further object of the present invention to provide an easy but effective means of cleaning the tar residue that builds up on the inside of the hollow tube of the cigarette holder.

Certain of the foregoing and related objects are readily attained according to the present invention by the provision of a cigarette holder, comprising a hollow tube having a front end serving as a mouthpiece and a rear end over which a cigarette is receivable; and a clip attached to said tube comprising a pair of cooperating, opposing, openable jaws to removably hold the cigarette over said rear end of said tube. It is preferable that said jaws each have an opposing end tip, and said jaws are movable from a closed position wherein said end tips are in contact with each other to an open position wherein said end tips are spaced apart from each other. Advantageously, said jaws are spring-loaded and normally assume said closed position via said spring-loading and are manually movable to said open position. Furthermore, it is preferred that each of said jaws further comprise a finger grip formed therein, wherein said finger grips are manually compressable towards each other to move said jaws from said normal closed position to said open position. Advantageously, said jaws are spaced apart from and disposed above said hollow tube. It is also preferred that said jaws cross over each other between said end tips and said finger grips.

In addition, desirably the cigarette holder further comprises a mouthpiece mounted on said front end of said tube. In the preferred embodiment, the cigarette holder also further comprises an upwardly extending extension mounted to said tube for mounting said clip to said tube.

It is preferred that at least a portion of said end tips of said jaws extend beyond said rear end of said tube. Additionally, in the preferred embodiment, a band is disposed around said tube and said clip for holding said clip to said tube. Preferably, said tube and said clip are metal.

Certain of the foregoing and related objects are also readily attained according to the present invention by the provision of a kit for cleaning a cigarette holder, comprising a cigarette holder, comprising a hollow tube having a front end serving as a mouthpiece and a rear end over which a cigarette is receivable; and a clip attached to said tube comprising a pair of cooperating, opposing, openable jaws to removably hold the cigarette over said rear end of said tube; and a solid, elongated rod insertable into said hollow tube of said cigarette holder, to remove residue from the inside of said hollow tube. Preferably, said hollow tube of said cigarette holder has an inner diameter which is larger than a diameter of said solid rod.

Additionally, certain of the foregoing and related objects are also readily attained according to the present invention by the provision of a method of holding a cigarette, comprising the steps of providing a cigarette having a front end and an opposite rear end and a cigarette holder, comprising a hollow tube having a front end serving as a mouthpiece and a rear end over which a cigarette is receivable; and a clip attached to said tube comprising a pair of cooperating, opposing, openable jaws to removably hold the cigarette over said rear end of said tube, wherein said jaws each have an opposing end tip, and said jaws are movable from a closed position wherein said end tips are in contact with each other to an open position wherein said end tips are spaced apart from each other; moving said jaws into said open position; inserting said rear end of said cigarette over said rear end of said hollow tube of said cigarette holder; and moving said jaws into said closed position to grasp a portion of said cigarette between said end tips.

Preferably, the method further comprises the steps of, prior to said step of moving said jaws into said open position, inserting said rear end of said cigarette over said end tips of said cigarette holder, when said end tips are in said closed position; moving said jaws into said open position, to expand said rear end of said cigarette; moving said jaws into said closed position; and removing said cigarette from said end tips.

Desirably, said jaws are spring-loaded and normally assume said closed position via said spring-loading and are manually moveable to said open position. It is also desirable that each of said jaws further comprise a finger grip formed therein, wherein said finger grips are manually compressable towards each other to move said jaws from said normal closed position to said open position. Advantageously, said jaws cross over each other between said end tips and said finger grips. It is also preferred that the method further comprises a mouthpiece mounted on said front end of said tube. Preferably, at least a portion of said end tips of said jaws extend beyond said rear end of said tube.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

DETAILED DESCRIPTION OF THE PREFERRED EMBODIMENTS

Figure 1:
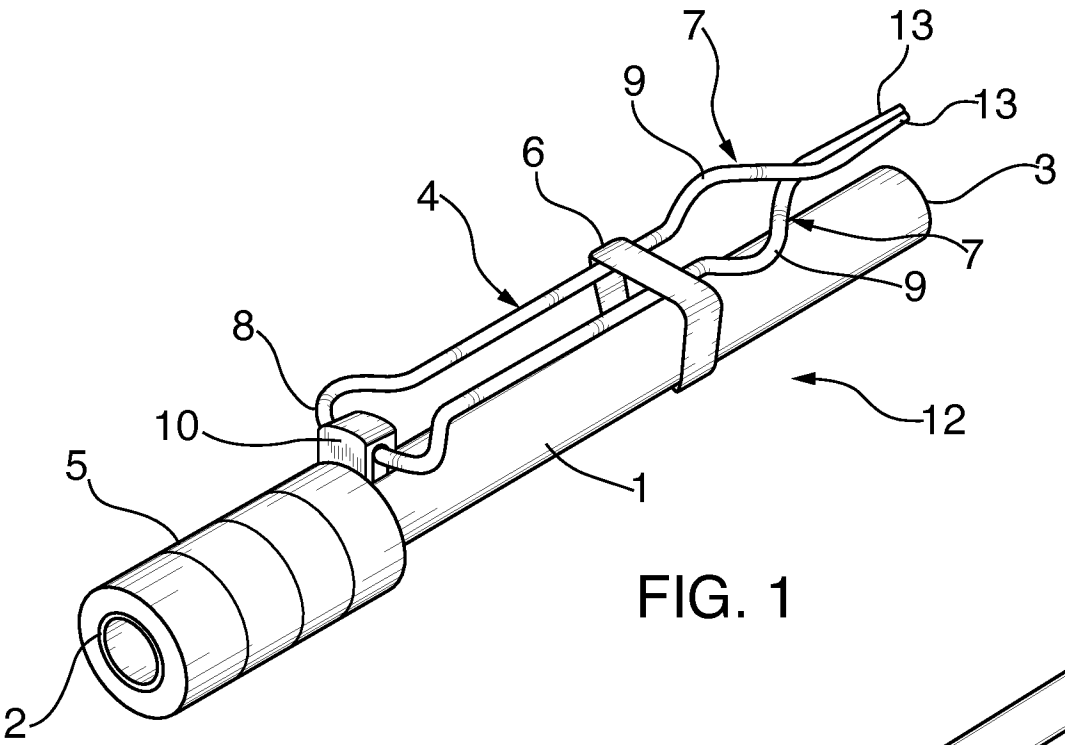
FIG. 1 is a perspective view of the cigarette holder, according to the present invention.

Turning now in detail to the drawings, and in particular FIG. 1, which shows the cigarette holder, generally designated by reference numeral 12, according to the present invention. Cigarette holder 12 is utilized to hold a cigarette 100, preferably by its paper wrapper 11 (see FIGS. 5-6), to permit cigarette 100 to be smoked to completion without burning the user's fingers or lips. As seen in FIG. 1, cigarette holder 12 includes a hollow tube 1 having a front end 2 serving as a mouthpiece and a rear end 3 over which a cigarette 100 is receivable (see FIGS. 5-6).

Figure 5:
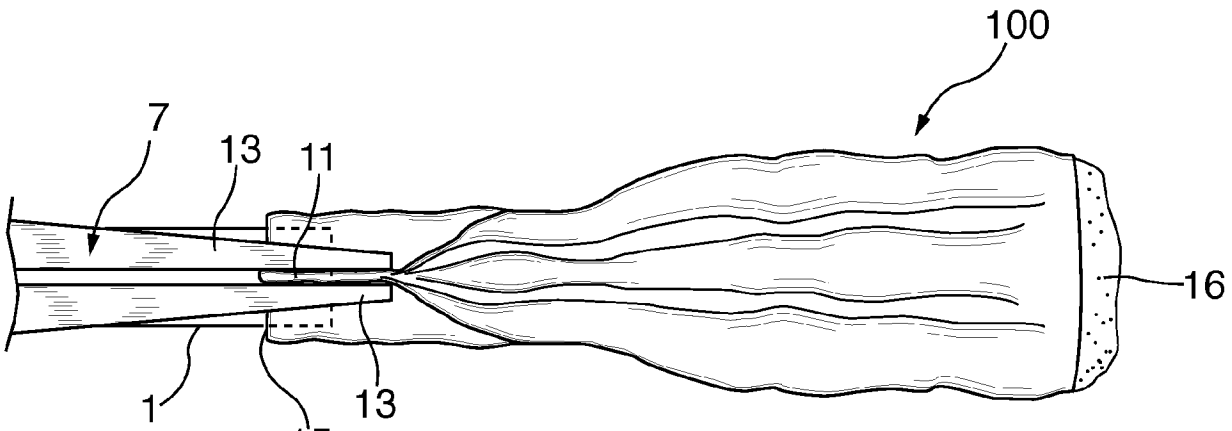
FIG. 5 is an enlarged top sectional view of a cigarette received over the end of the hollow tube of the cigarette holder and the jaws grasping the cigarette wrapper.
Figure 6:
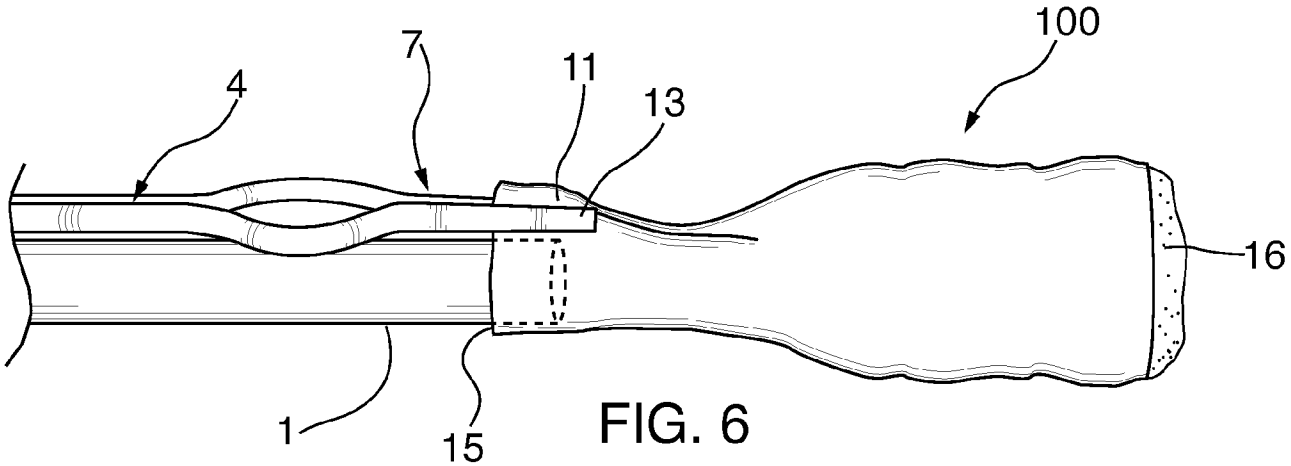
FIG. 6 is a front elevational view of a cigarette received over the end of the hollow tube of the cigarette holder and the jaws grasping the cigarette wrapper.

As also seen in FIG. 1, cigarette holder 12 also includes a clip 4 to hold the cigarette 100 to tube 1. As shown in FIGS. 5-6, the non-burning end 15 of the cigarette 100 is held onto tube 1 by clip 4, so that cigarette 100 forms an airtight seal with the tube 1. As a result, when air is drawn into rear end 3 of tube 1, the air is forced to enter the cigarette 100 through its burning end 16. The air then passes through the full length of tube 1 to its front end 2 and is thereby drawn into the smoker. Because the smoke is drawn through the entire length of tube 1, it is also cooled to a comfortable level, before it enters the smoker. Furthermore, the tube 1 separates the cigarette 100 from the smoker's lips to prevent the smoker from burning their lips as the cigarette 100 is burned to completion.

Cigarette holder 12 includes hollow tube 1 which is shown as being a round or cylindrical shape, but may be square, triangular, oval or other suitable shapes. Moreover, it is preferable that tube 1 is made of brass but other suitable materials can be utilized, such as, another metal or plastic. In the preferred embodiment, the length of the tube 1 is approximately 2½ inches and has an outside diameter of approximately ⅛ of an inch and an inside diameter of 3/32 of an inch.

As seen in FIG. 1, cigarette holder 12 also includes a clip 4 which is attached to tube 1. Clip 4 includes a pair of cooperating, opposing, openable jaws 7 to removably hold the cigarette 100 (as seen in FIGS. 5-6) over rear end 3 of tube 1. In the preferred embodiment, clip 4 is made of stainless steel spring wire, however, it can be appreciated that it can be made of other suitable materials, such as, for example, other metals, plastic, or a combination of metal and plastic.

Figure 3:
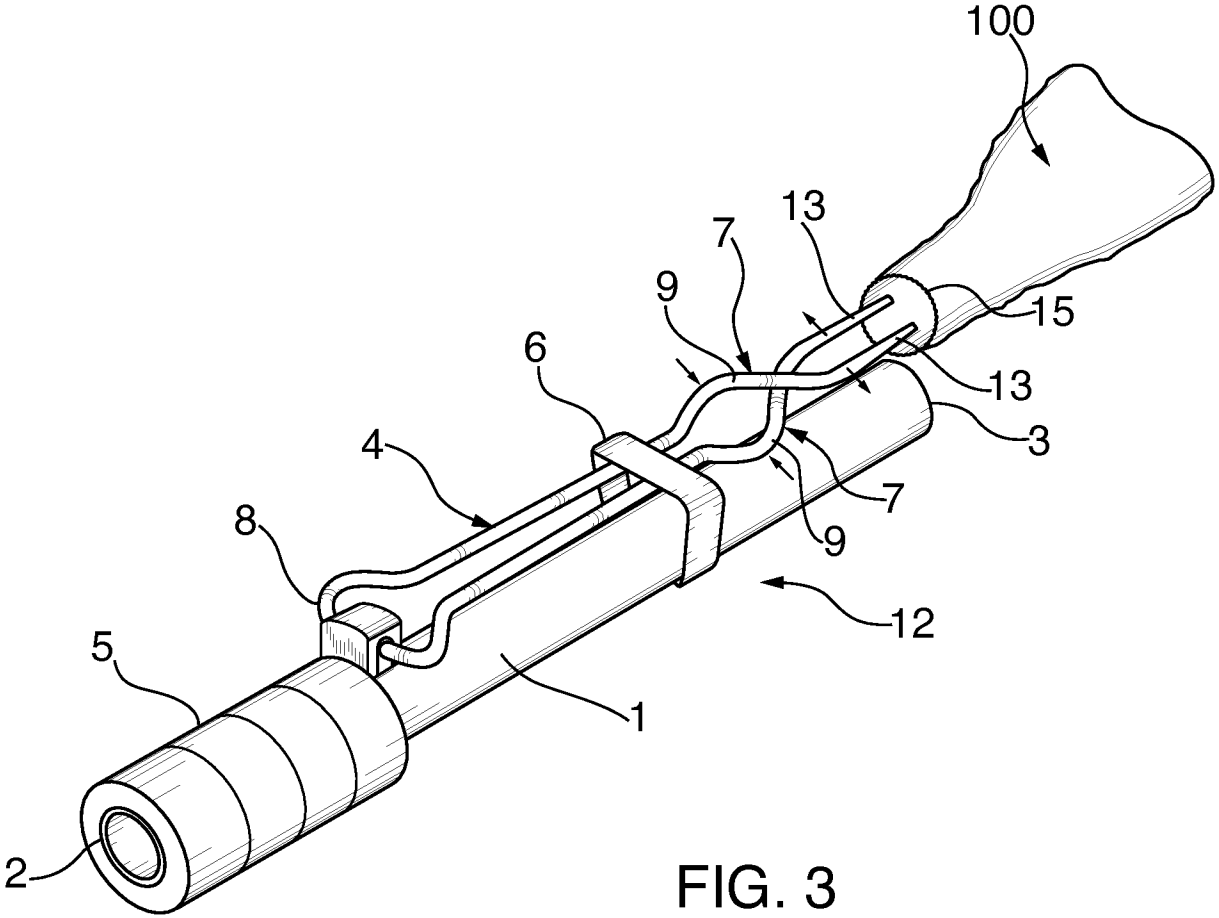
FIG. 3 is a view similar to FIG. 1, but with a cigarette placed over the jaws of the cigarette holder and the end tips being separated from each other to open the end of the cigarette.
Figure 4:
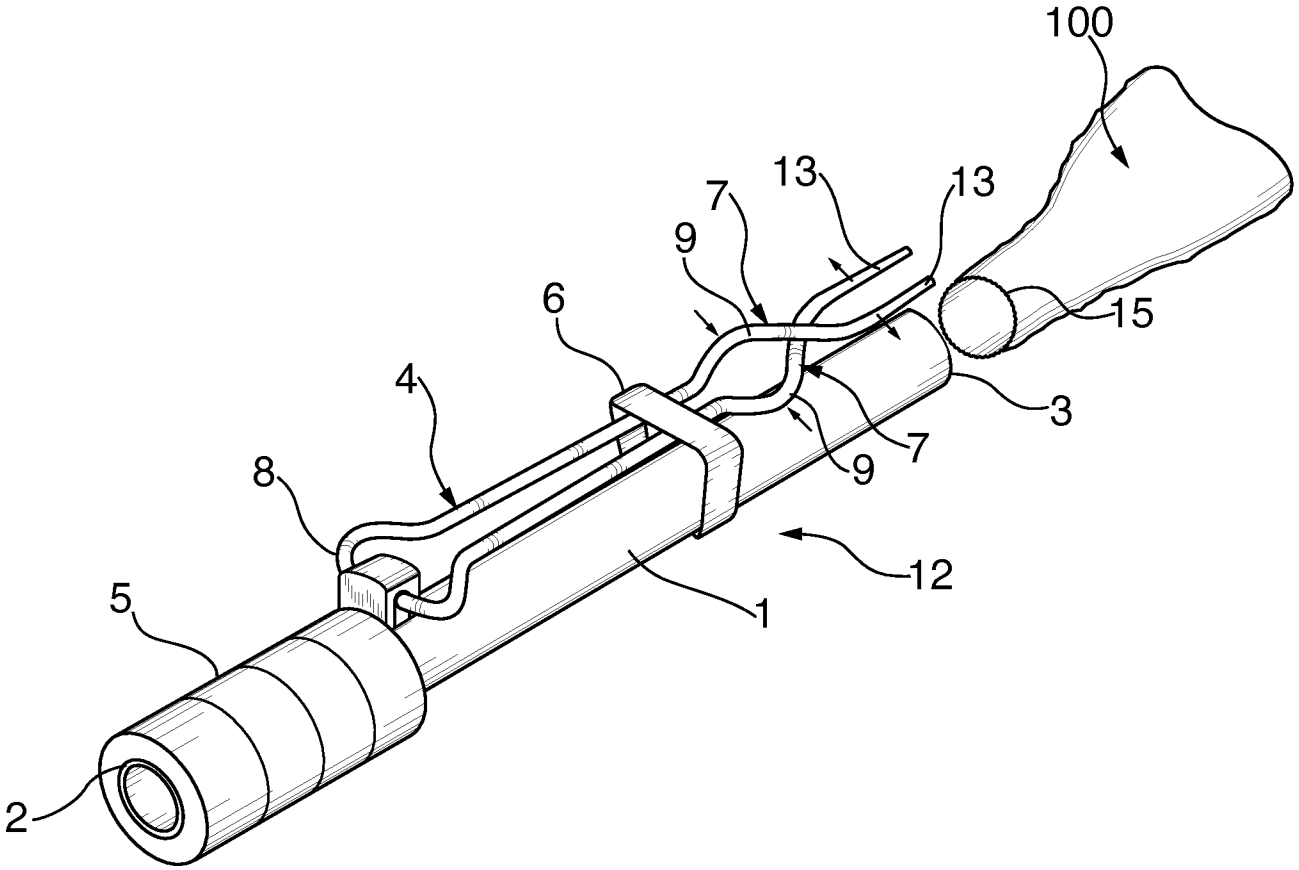
FIG. 4 is a view similar to FIG. 1, but with the end tips of the jaws being separated from each other prior to the cigarette being received over the tube of the cigarette holder.

As also seen in FIG. 1, jaws 7 each have an opposing end tip 13, which are used in conjunction with each other to grasp the paper wrapper 11 of cigarette 100 (as seen in FIGS. 5-6). Additionally, jaws 7 are movable from a closed position, as seen in FIGS. 1 and 5-6, where end tips 13 are in contact with each other, to an open position, as seen in FIG. 3-4, where end tips 13 are spaced apart from each other.

Preferably, jaws 7 are spring-loaded and normally assume the closed position seen in FIG. 1, via the spring-loading. Moreover, jaws 7 are manually movable to the open position, as seen in FIGS. 3-4. To assist in manually moving jaws 7 into their open position, it is preferred that each of jaws 7 further comprise an outwardly projecting finger grip 9 formed therein and jaws 7 cross over each other between end tips 13 and finger grips 9, as seen in FIG. 1. Preferably, finger grips 9 are generally U-shaped, however, other suitable shapes and configurations are possible. Finger grips 9 are manually compressable towards each, such as by pressure of the user's fingers, in order to move jaws 7 from their normal closed position to their open position. It is also preferable that at least a portion of end tips 13 of jaws 7 extend beyond rear end 3 of tube 1, as seen best in FIGS. 5-6.

Preferably, as seen best in FIGS. 1 and 6, jaws 7 are mounted in a position spaced apart from and disposed above tube 1. In particular, the rear end 8 of clip 4 is attached to tube 1 by means of extension 10. Extension 10 can be made of a metal or plastic material. As seen best in FIG. 1, extension 10 has a cutout formed therein which allows the rear end 8 of clip 4 to pass through it.

In order to further secure jaws 7 to tube 1, a band 6 is disposed around tube 1 and clip 4. As seen best in FIG. 1, band 6 wraps around clip 4 and tube 1 and can be soldered, welded or otherwise attached to the bottom of tube 1 to prevent band 6 and clip 4 from moving in relation to tube 1. Band 6 can be made of a metal or plastic material. However, any suitable material can be utilized.

In the preferred embodiment, a mouthpiece 5 is mounted on front end 2 of tube 1. Mouthpiece 5 is preferably secured to tube 1 by means of a friction fit, however, soldering, adhesive or other suitable means can be utilized. Preferably, mouthpiece 5 is made of brass but other suitable materials can be used. Mouthpiece 5 can also function as a method of securing clip 4 to tube 1.

To use the present invention, the smoker may have to open up the non-burning end 15 of the paper wrapper 11 of cigarette 100 if it is smaller than the outside diameter of tube 1, so that the rear, non-burning end 15 of cigarette 100 is large enough to fit over the outside of the rear end 3 of hollow tube 1. In order to open up the paper wrapper 11 of cigarette 100, as seen in FIG. 3, because jaws 7 extend beyond the rear end 3 of tube 1, the end tips 13 of jaws 7 can be inserted into the non-burning end 15 of the paper wrapper 11 of cigarette 100, while jaws 7 are in the normal closed position. Opposing pressure is applied to finger grips 9, thereby moving them together, and, in turn, moving end tips 13 apart from each other, to their open position, to therefore expand the non-burning end 15 of the paper wrapper 11 of cigarette 100. This step may have to be repeated so that paper wrapper 11 of cigarette 100 is large enough to allow it to fit onto tube 1.

Next, in order to attach the cigarette 100 to the cigarette holder 12, the smoker applies opposing pressure to finger grips 9 to move jaws 7 from their closed position, to their open position, wherein the end tips 13 are spaced apart. The user then inserts the rear end 3 of tube 1 into the non-burning end 15 of the cigarette 100. The user then relaxes the opposing pressure on finger grips 9, thereby allowing jaws 7 of clip 4 to move to their closed position. While doing so, as end tips 13 move towards each other, they gather any excess of the paper wrapper 11 of the non-burning end 15 of the cigarette 100 around the rear end 3 of tube 1, as shown in FIGS. 5-6, forming an airtight seal around tube 1.

The smoker can then place their lips on the mouthpiece 5 of the cigarette holder 12 and draw smoke from the front, burning end 16 of the cigarette 100. The smoke will cool as it passes through the full length of the remainder of the cigarette 100 and then through the full length of the tube 1. The jaws are used to gather the paper wrapper 11 of the cigarette 100 around the hollow tube 1 until it is tightly wrapped around the hollow tube 1, thereby minimizing the amount of air allowed to enter the rear end 3 of tube 1. Because the cigarette 100 is held only by the paper wrapper 11 located on its non-burning end 15, the cigarette 100 can continue to be smoked until the substance held within its paper wrapper 11 is completely burned up, leaving only the small amount of paper wrapper 11 held between the end tips 13 of jaws 7 of clip 4 and around the rear end 3 of hollow tube 1.

Figure 2:
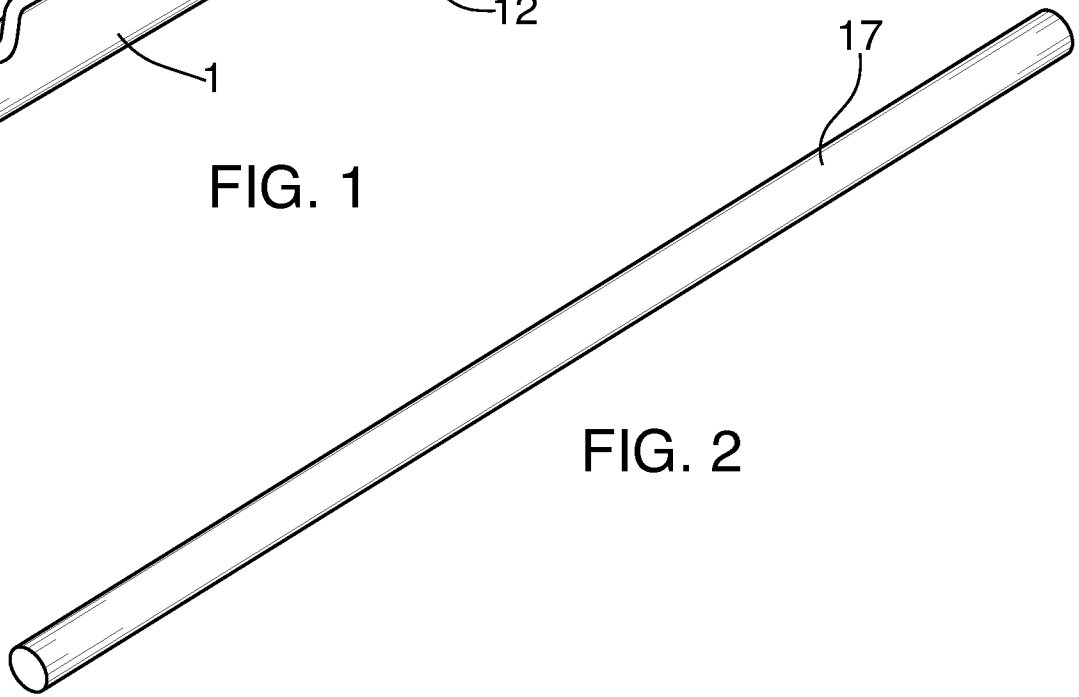
FIG. 2 is a perspective view of the cleaning rod for the cigarette holder, according to the present invention.

Furthermore, after using the cigarette holder 12 of the present invention, a number of times, tar and other residue left from the smoke of the cigarette may remain on the inside of tube 1. Eventually this residue can restrict the flow of air through tube 1 to an undesirable level. To clean this residue from the inside of tube 1, a cleaning rod 17, as seen in FIG. 2, can be utilized. Cleaning rod 17 is a solid, elongated rod which is insertable into hollow tube 1 of cigarette holder 12, to remove the residue from the inside of hollow tube 1.

In particular, cleaning rod 17 can be pushed through tube 1 from either its front end 2 or rear end 3. The hollow tube 1 of cigarette holder 12 has an inner diameter which is slightly larger than the diameter of cleaning rod 17. Cleaning rod 17 also has a length which is greater than the length of tube 1, to allow it to be pushed through tube 1. Preferably, cleaning rod 17 has a length of 5 inches and a diameter of 3/32 of an inch. Particularly, the outside diameter of cleaning rod 17 is made to be only a few thousandths of an inch less in diameter than the inside of hollow tube 1 so that passing cleaning rod 17 through hollow tube 1 only one time will clean off most of any residue inside hollow tube 1.

While particular embodiments of the invention have been described, it is not intended that the invention be limited thereto, as it is intended that the invention be as broad in scope as the prior art will allow and that the specification be read likewise. It will therefore be appreciated by those skilled in the art that other modifications could be made thereto without departing from the spirit and scope of the invention.

What is claimed is:

1. A cigarette holder for holding a cigarette having a paper wrapper containing a substance to be smoked, while being smoked, comprising:

a hollow tube having an outside exposed surface, an open front end serving as a mouthpiece, and an open rear end, wherein said open rear end is configured and dimensioned for receipt of a paper wrapper of a cigarette around said outside exposed surface of said open rear end of said hollow tube; and a clip attached to said outside exposed surface of said tube comprising a pair of cooperating, opposing, openable jaws which are configured and dimensioned to removably hold the paper wrapper of the cigarette around said outside exposed surface of said open rear end of said tube.

2. The holder according to claim 1, wherein:

said jaws each have an opposing end tip, and said jaws are movable from a normal closed position wherein said end tips are in contact with each other to an open position wherein said end tips are spaced apart from each other.

3. The holder according to claim 2, wherein:

said jaws are spring-loaded and normally assume said normal closed position via said spring-loading and are manually movable to said open position.

4. The holder according to claim 2, wherein:

each of said jaws further comprise a finger grip formed therein, wherein said finger grips are manually compressible towards each other to move said jaws from said normal closed position to said open position.

5. The holder according to claim 1, wherein:

said jaws are spaced apart from and disposed above said outside exposed surface of said hollow tube.

6. The holder according to claim 4, wherein:

said jaws cross over each other between said end tips and said finger grips.

7. The holder according to claim 1, further comprising:

a mouthpiece mounted on said front end of said tube.

8. The holder according to claim 1, further comprising:

an upwardly extending extension mounted to said outside exposed surface of said tube for mounting said clip to said outside exposed surface of said tube.

9. The holder according to claim 2, wherein:

at least a portion of said end tips of said jaws extend beyond said rear end of said tube.

10. The holder according to claim 1, further comprising:

a band disposed around said tube and said clip for holding said clip to said tube.

11. The holder according to claim 1, wherein:

said tube and said clip are metal.

12. A kit for cleaning a cigarette holder, comprising:

a cigarette holder for holding a cigarette having a paper wrapper containing a substance to be smoked, while being smoked, comprising a hollow tube having an outside exposed surface, an open front end serving as a mouthpiece, and an open rear end, wherein said open rear end is configured and dimensioned for receipt of a paper wrapper of a cigarette around said outside exposed surface of said open rear end of said hollow tube; and a clip attached to said outside exposed surface of said tube comprising a pair of cooperating, opposing, openable jaws which are configured and dimensioned to removably hold the paper wrapper of the cigarette around said outside exposed surface of said open rear end of said tube; and a solid, elongated rod insertable into said hollow tube of said cigarette holder, to remove residue from the inside of said hollow tube.

13. The kit according to claim 12, wherein:

said hollow tube of said cigarette holder has an inner diameter which is larger than a diameter of said solid rod.

14. A method of holding a cigarette while being smoked, comprising the steps of:

providing a cigarette having a paper wrapper containing a substance to be smoked, a front end, and an opposite rear end and a cigarette holder for holding said cigarette while being smoked, comprising a hollow tube having an outside exposed surface, an open front end serving as a mouthpiece, and an open rear end, wherein said open rear end is configured and dimensioned for receipt of said paper wrapper of said cigarette around said outside exposed surface of said open rear end of said hollow tube; and a clip attached to said outside exposed surface of said tube comprising a pair of cooperating, opposing, openable jaws which are configured and dimensioned to removably hold said paper wrapper of said cigarette around said outside exposed surface of said open rear end of said tube, wherein said jaws each have an opposing end tip, and said jaws are movable from a normal closed position wherein said end tips are in contact with each other to an open position wherein said end tips are spaced apart from each other;

moving said jaws into said open position;

positioning said rear end of said cigarette around said outside exposed surface of said rear end of said hollow tube of said cigarette holder; and moving said jaws into said normal closed position to grasp a portion of said paper wrapper of said cigarette between said end tips.

15. The method according to claim 14, further comprising the steps of:

prior to said step of moving said jaws into said open position, inserting said rear end of said cigarette around said end tips of said cigarette holder, when said end tips are in said normal closed position;

moving said jaws into said open position, to expand said rear end of said cigarette;

moving said jaws into said normal closed position; and removing said cigarette from said end tips.

16. The method according to claim 14, wherein:

said jaws are spring-loaded and normally assume said normal closed position via said spring-loading and are manually moveable to said open position.

17. The method according to claim 14, wherein:

each of said jaws further comprise a finger grip formed therein, wherein said finger grips are manually compressible towards each other to move said jaws from said normal closed position to said open position.

18. The method according to claim 17, wherein:

said jaws cross over each other between said end tips and said finger grips.

19. The method according to claim 14, further comprising:

a mouthpiece mounted on said front end of said tube.

20. The method according to claim 14, wherein:

at least a portion of said end tips of said jaws extend beyond said rear end of said tube.

21. The holder according to claim 1, wherein:

said jaws grasp the paper wrapper of a rear portion of the cigarette generally adjacent to said open rear end of said tube.

* * * * *